United States Patent [19]

Ipcinski

[11] Patent Number: 5,046,142

[45] Date of Patent: Sep. 3, 1991

[54] SLIDE SWITCH

[75] Inventor: Ralph Ipcinski, Hollis, N.H.

[73] Assignee: C&K Components, Inc.

[21] Appl. No.: 552,331

[22] Filed: Jul. 12, 1990

Related U.S. Application Data

[63] Continuation-in-part of Ser. No. 419,651, Oct. 11, 1989, abandoned.

[51] Int. Cl.[5] ..... H01H 11/00; H01H 15/00

[52] U.S. Cl. ..... 200/16 F; 200/16 D; 29/622

[58] Field of Search ..... 200/16 D, 16 F, 6 BB, 200/DIG. 6, 254; 29/622, 882, 883, 884

[56] References Cited

U.S. PATENT DOCUMENTS

| | | | |
|---|---|---|---|
| 4,016,377 | 4/1977 | Iwasaki | 200/16 F |
| 4,687,887 | 8/1987 | Stokoe et al. | 200/16 F |
| 4,764,645 | 8/1988 | Takasawa | 200/16 F |
| 4,945,195 | 7/1990 | Ipcinski | 200/6 BB X |

*Primary Examiner*—J. R. Scott

[57] ABSTRACT

This is a slide switch which is formed by insert molding the base of the switch around a metal stamping which has a central portion arced to move the terminal elements closer together prior to molding. The movable contact assemblies comprise an actuator associated with a movable contact. The movable contact includes a first and second arm which are in spaced apposed relation to each other.

3 Claims, 4 Drawing Sheets

SLIDE SWITCH

This is a continuation-in-part of co-pending application Ser. No. 07/419,651 filed on Oct. 11, 1989, now abandoned.

BACKGROUND OF THE INVENTION

This invention relates generally to switches and more specifically to miniature slide switches.

The applicant herein filed an application for a rotary switch utilizing a similar method of insert molding to form the switch. See U.S. patent application Ser. No. 07/325,392, filed Mar. 20, 1989, now U.S. Pat. No. 4,945,195.

SUMMARY OF THE INVENTION

The invention disclosed herein comprises a slide switch comprising a case, a cover, a first fixed contact, a second fixed contact, and a movable contact. The case is box like in configuration and having its base formed by insert molding around a metal stamping. Prior to insert molding the metal stamping includes a contact assembly, the contact assembly including a first contact element extending integrally from a runner to an integral center element and a second contact element extending integrally to another runner. The first and second contact elements each have a free terminal ends which are moved closer to each other by bending the center element upwardly in a general arced shape while maintaining the first and second contact elements on the same horizontal plane. The upper surface of the base has a pair of spaced first and second ribs, formed in spaced parallel relation to each other and to a second long side edge. A pair of first channels are formed in the first rib extending from the first long side edge to a third channel and in spaced parallel relation with the first and a second side edges. The upper surface of the base has a pair of spaced second channels formed in the second rib extending from the second long side edge to the third channel and in spaced parallel relation with the first and a second side edges. The third channel extends from first side edge to the second side edge, in spaced parallel relation with the first and second long side edges and in right angle relation with the first and second channels. An actuator 20 having grooved ribs on each side of a cavity engages the movable contact. The movable contact includes a bottom portion having a first arm extending upwardly from one long side edge and a second arm extending upward from the other long edge. The first and second arms are in spaced opposed relation to each other. The bottom portion has extensions which engage the grooves of the ribs of the actuator.

BRIEF DESCRIPTION OF THE DRAWINGS

Further details are explained below with the help of the example(s) illustrated in the attached drawings in which.

DESCRIPTION OF THE PREFERRED EMBODIMENT(S)

Figure 1:
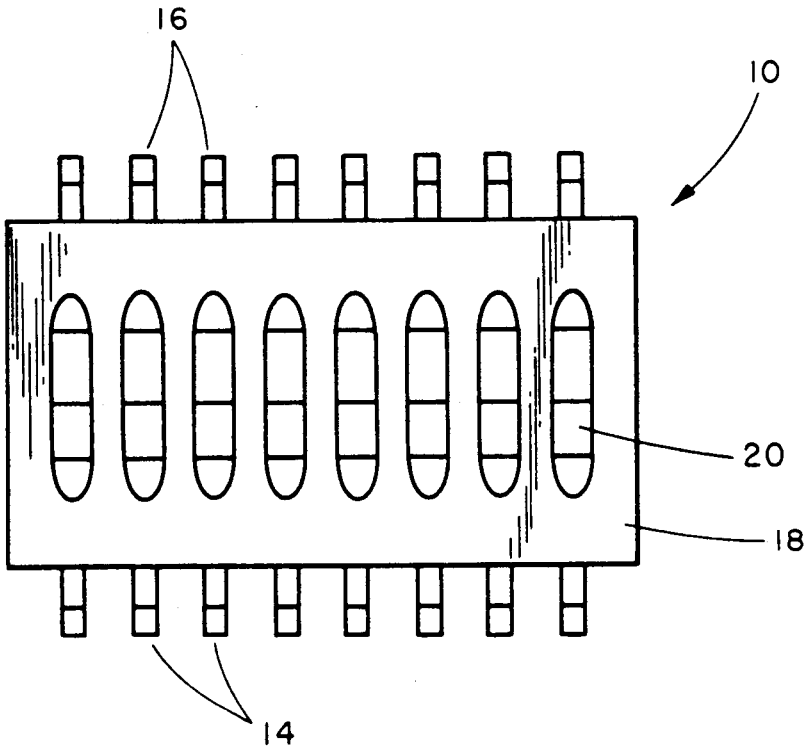
FIG. 1 is a top plan view of the miniature slide switch according to the present invention.

There is shown in the drawings a miniature slide switch 10 comprising a case 12, a series of first fixed contacts 14, a series of second fixed contacts 16, a cover 18, a series of actuators 20 and a series of movable contacts 21. The case 12 is formed by insert molding around a contact assembly 22 as will be more fully set forth hereinafter.

Figure 3:
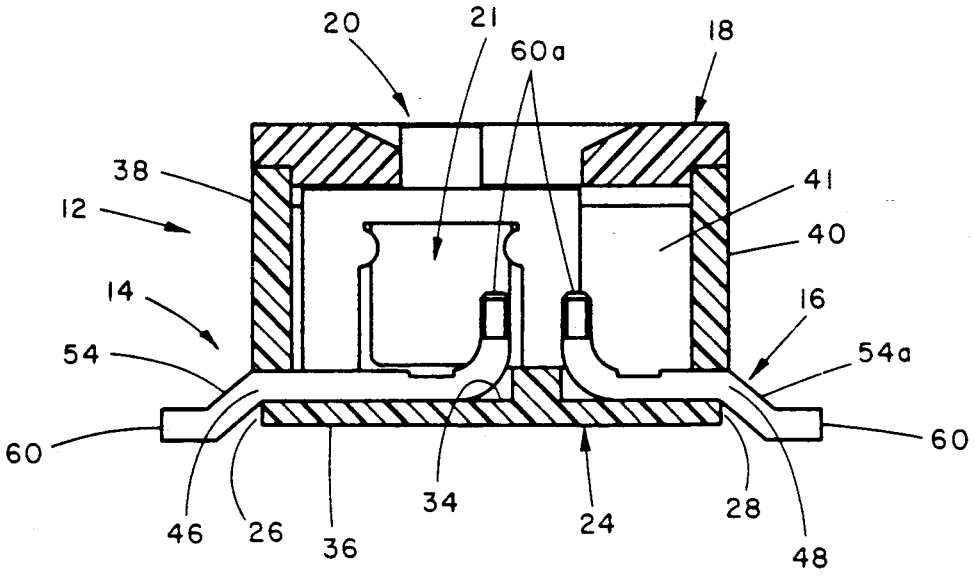
FIG. 3 is a sectional view of the miniature slide switch shown in FIG. 1.

The case 12 includes a base 24 having a first long side edge 26, a second long side edge 28, a first side edge 30 and a second side edge 32. The first and second long side edges 26, 28 are in spaced parallel relation with each other and connected at their ends by the first and second side edges 30, 32. The base 24 also includes an upper surface 34 and a lower surface 36. A first long side wall 38 extends from the first long side edge 26 and a second long side wall 40 extends from the second long side edge 28 in spaced parallel relation to the first long side wall 38. A first short side wall 42 extends from the first side edge 30 and a second short side wall 44 extends from the second side edge 32. The first and second short side wall 42, 44 connect the first and second long side walls 38, 40 and are in spaced parallel relation to each other. A series of first channels 46 are formed through the first long side wall 38 in close proximity to the base 24 as indicated in FIG. 3. The first channels 46 are in spaced, parallel relation to each other. A series of second channels 48 are formed through the second long side walls 40 in close proximity to the base 24 as indicated in FIG. 3. The second channels 48 are in spaced, parallel relation to each other and in opposed aligned relation with the first channels 46. The first and second long side edges 26, 28 are inset from the exteriors of the first and second long side walls 38, 40 as shown in FIG. 3. The first and second long side walls 38, 40, the first and second short side wall 42, 44 and the base 24 define a cavity 41.

Figure 4:
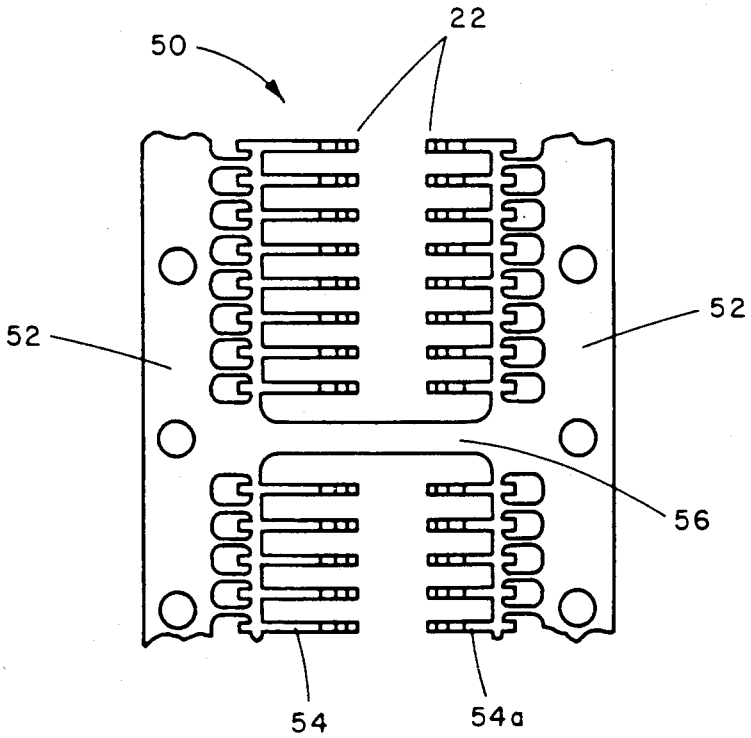
FIG. 4 is a top plan of the metal stamping according to the present invention.

There is shown in FIG. 4 a metal stamping 50 comprising a series of the contact assemblies 22 attached to runners 52. The runners 52 are in spaced parallel relation to each other and in right angle relationship to the contact assemblies 22. Each of the contact assemblies is in spaced parallel relation to the other contact assemblies. Each of the contact assemblies 22 includes a first contact element 54 which extends integrally from one runner 52 to an integral center element 56 and a second contact element 54*a* which extends integrally to the other runner 52.

Figure 4A:
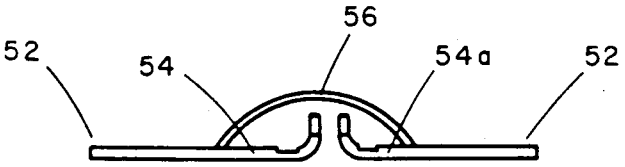
FIG. 4*a* is a side elevational view of the metal stamping shown in FIG. 4 after bending the center element upwardly in a general arced shape while maintaining the first and second contact elements on the same horizontal plane.
Figure 5:
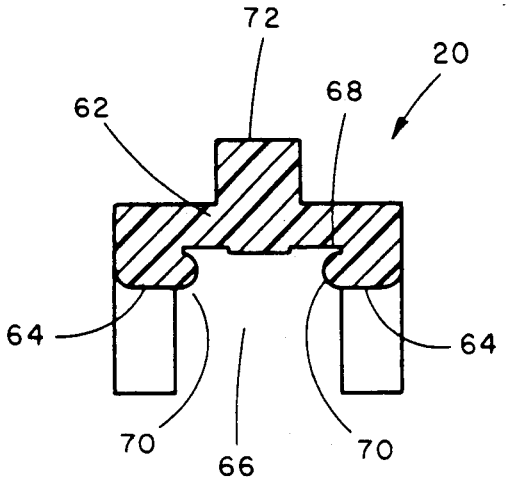
FIG. 5 is a sectional view, of the support portion of the actuator according to the present invention.
Figure 6:
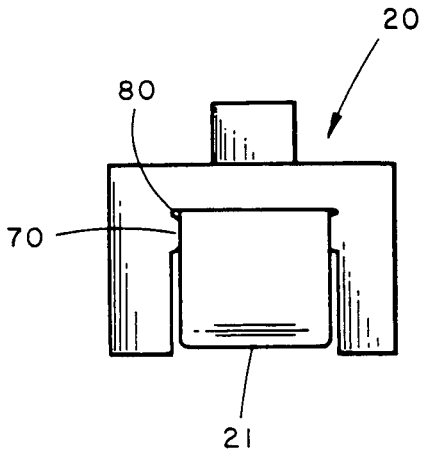
FIG. 6 is a side elevational view, of the actuator and the movable contact according to the present invention.
Figure 7:
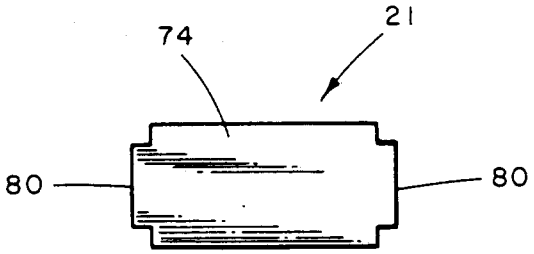
FIG. 7 is a bottom plan view of the movable contact according to the present invention.
Figure 8:
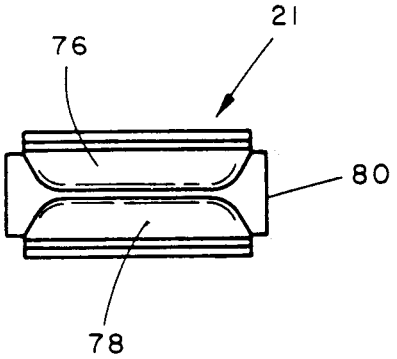
FIG. 8 is a top plan view of the movable contact shown in FIG. 7.
Figure 9:
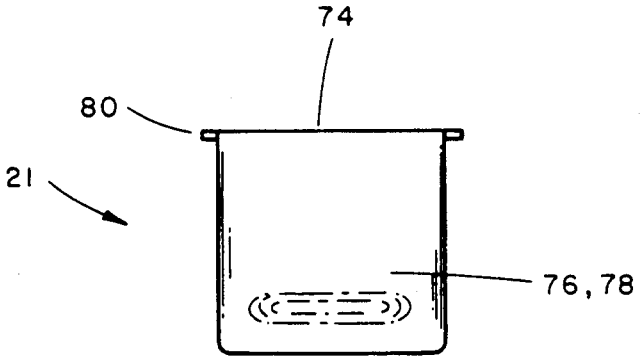
FIG. 9 is a side elevational view of the movable contact shown in FIG. 7.
Figure 10:
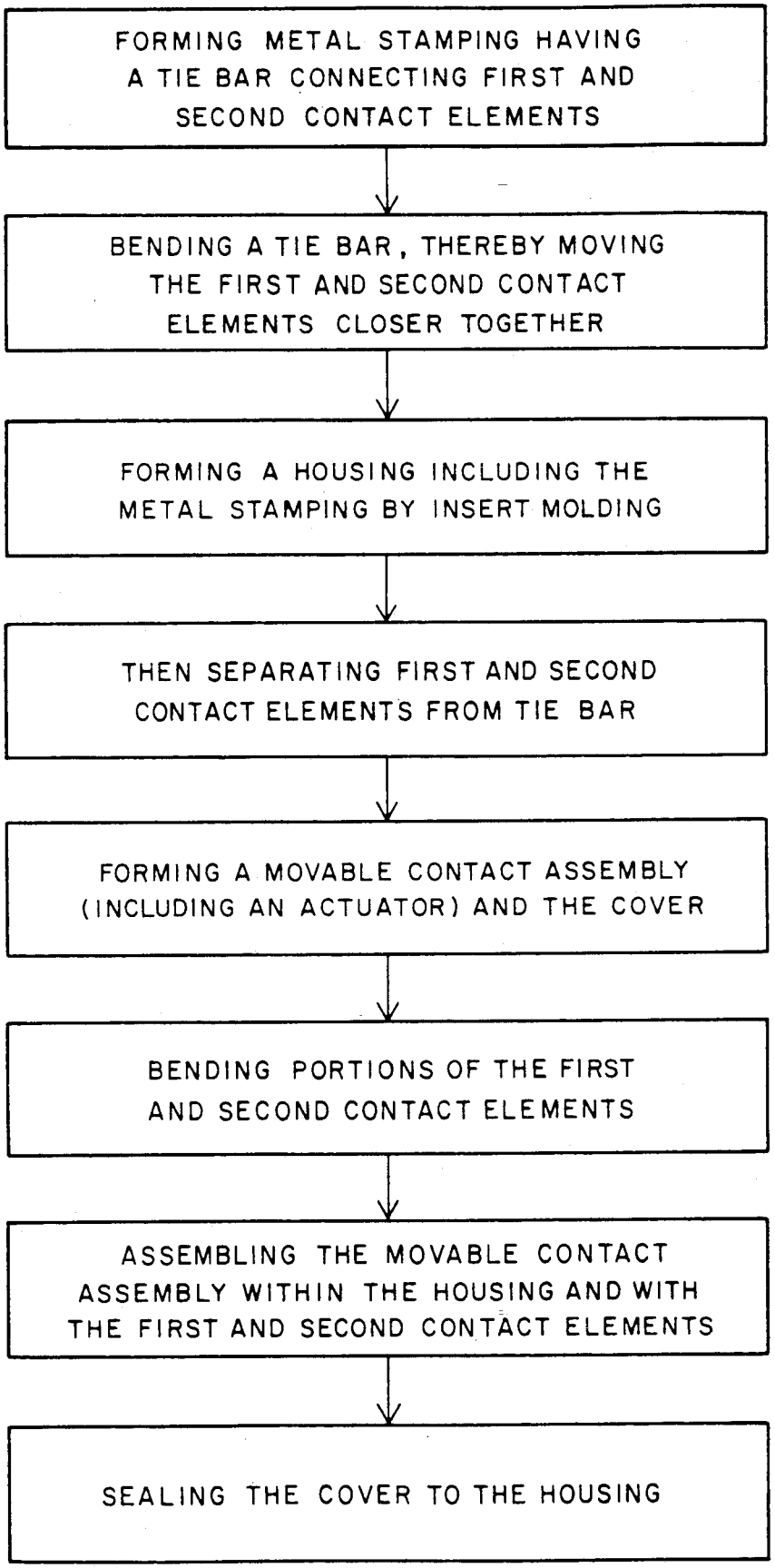
FIG. 10 is a flow diagram illustrating the method of making the slide switches.

Prior to the molding process, the free terminal ends 60*a* of the first and second contact elements 54, 54*a* are moved closer to each other by bending the center element (i.e. the tie bar 56) upwardly in a general arced shape as shown in FIG. 4*a* while maintaining the first and second contact elements 54, 54*a* on the same horizontal plane. This reduces the distance between the fixed contacts to their final spacing. The free terminal ends 60*a* of the first and second contact elements 54, 54*a* are then bent upwardly as shown in FIG. 4*a*. The metal stamping 50 is positioned in an injection mold (not shown), for example, and the case 12 is formed around the stamping 50 during the molding process. After the insert molding process, the metal stamping 50 is separated from the center elements 56 and the runners 52 by a cutting process providing separate first and second contact elements 54, 54*a*. The insert molding process forms the first channels 46 through which the first contact elements 54 extend and the second channel 48 through which the second contact elements 54*a* extend while simultaneously positioning the first and second contact elements 54*a* in their respective channels 46, 48. Each of the first and second contact elements 54, 54*a* includes a first free terminal end 60 and a second free terminal end 60*a*. Each of the first free terminal ends 60 extends beyond the area defined by the first and second long side walls 38, 40 and each of the second free terminal ends 60*a* extends into the cavity 41. The first free terminal ends 60 are slightly bent over the insets provided by the relationship of the first and second long side edges 26, 28 and the exteriors of the first and second long side walls 38, 40 and the second free terminal ends 60*a* of the first and second contact elements 54, 54*a* are bent upwardly away from the upper surface 34 of the base 24 in spaced parallel relation to each other as shown in FIG. 3 and as stated heretofore.

The actuator 20 comprises a support portion 62 having spaced long edges. Each of the long edges has an integral rail 64 extending therefrom. The rails 64 are in spaced parallel relation to each other and with the inner surface of the support portion 62 define a through channel 66. The inner facing surface of each of the rails 64 is spaced from the inner surface of the support portion 62 which is provided with a rib 70 defining a groove 68. A cylindrical stud 72 is formed on the center of the external surface of the support portion 62.

A movable contact 21 formed of an electrically conductive material is provided for each of the actuators 20. Each of the movable contacts 21 includes a generally rectangular bottom portion 74 having a flexible first arm 76 extending upward from one long edge and a flexible second arm 78 extending upward from the other long edge. The first and second arms 76, 78 are in spaced opposed relation to each other and each of their free terminal ends is bowed inwardly bringing the free terminal ends in close proximity to each other. A rectangular extension 80 projects from each short end of the bottom portion 74, is planar therewith and is narrower than the bottom portion 74.

Assembly of the actuator 20 and the movable contact 21 is accomplished by placing one of the extensions 80 under one rib 70 of the actuator 20 while simultaneously placing the other extension 80 under the other rib 70. The movable contact 21 is positioned so that the first and second arms 76, 78 are in right angle relation to the ribs 70 and extend in a direction opposite to that of the stud 72.

The cover 18 comprises a body portion 82 which is generally rectangular and formed of a plastic material. A series of oval openings 84 are formed through the cover 18, the number of which correspond to the number of actuators 20. The axis of each of the openings 84 is in spaced parallel relation to each other as shown in FIG. 1. The cover 18 includes a lower surface having a shelf 86 formed around the periphery of the cover 18 as indicated at FIG. 3.

Figure 2:
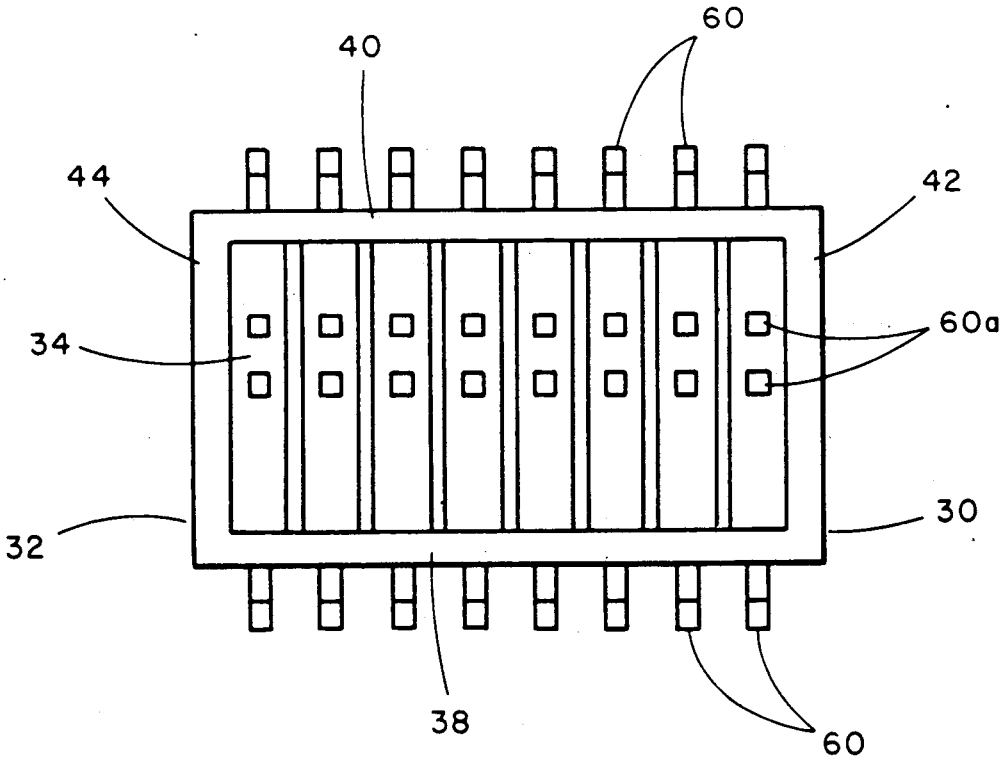
FIG. 2 is a top plan view, of the miniature slide switch shown in FIG. 1.

Assembly of the subassembly of the actuator 20 and the movable contact 21 with the case 12 is accomplished by positioning the subassembly of the actuator 20 and the movable contact 21 on each of the contact elements 54 as indicated in FIGS. 2 and 3. The cover 18 is then positioned with the top edges of the first and second long side walls 38, 40 and the first and second short side wall 42, 44 positioned in the shelf 86 and a stud 72 of each of the actuators 20 extending through an opening 84. The cover 18 can then be adhered to the case 12 in a manner well known in the art such as an adhesive or welding procedure. Manual movement of the stud 72 will make and break the use of the movable contact 21 as a bridging element with the first and second free terminal end 60, 60*a* of the first and second fixed contacts 14, 16.

The steps if forming and assembling the slide switch 10 are as follows:

forming the metal stamping 50;

bending the center element 56 while movably holding the first and second contact elements 54, 54*a* on the same horizontal plane;

bending the free terminal ends of the first and second contact elements 54, 54*a* upwardly;

positioning the metal stamping 50 in an injection mold;

forming the case 12 around the metal stamping 50;

separating the first and second contact elements 54, 54*a* from the center element 56 and the runners 52;

at some time, forming the actual 20 and the movable contact 21 including any necessary bending and subsequently engaging the actuator 20 to the movable contact 21.

At some time, forming the cover 18 to include one or more actuator openings 84.

positioning one or more actuator-movable contact 20, 21 subassemblies within the case 12 and on a first or second contact element 54, 54*a*; and engaging the cover 18 to the case 12.

What I claim is:

1. A slide switch comprising a case, a cover, a first fixed contact, a second fixed contact, and a movable contact assembly, the case having a base, the first and second fixed contacts each having an integral first free terminal end an integral second free terminal end, the first and second free terminal ends spaced from each other with the second free terminal ends positioned within the case in close proximity to the base and the first free terminal ends positioned outside of the case; the movable contact assembly comprising an actuator and a movable contact, each of the second free terminal ends in angular relation to the remaining portion of its respective fixed contact, in spaced, apposed, parallel relation to each other, the movable contact engaged with the actuator, and including first and second flexible arms in spaced opposed relation to each other, the first and second flexible arms engageable with the second free terminal ends, the case having side walls, the side walls having top edges, the cover engaged to the top edges.

2. A slide switch as set forth in claim 1 wherein the movable contact comprises a generally rectangular bottom portion having first and second long edges, a flexible first arm extending upward from the first long edge and a flexible second arm extending upward from the second long edge, the first and second arms in spaced opposed relation to each other, the first and second arms each having a free terminal end and each of the free terminal ends being bowed inwardly bringing the free terminal ends in close proximity to each other.

3. The method of forming a slide switch comprising the steps of:

forming a unitary metal stamping including fixed contact assemblies and a tie bar, each of the contact assemblies including a first contact element extending from the tie bar and a second contact element extending from the tie bar in a direction opposite from the first contact element and the first and a second contact elements having free terminal ends;

bending the tie bar thereby moving the first and second contact elements closer to each other;

insert molding the metal stamping to form a housing with the base of the housing around a portion of the metal stamping;

separating the first and second contact elements from the tie bar thereby forming free terminal ends of the first and second contact elements;

forming a movable contact assembly and a cover;

bending the first and second contact elements in close proximity to each of the free terminal end;

assembling the movable contact assembly within the housing and with the first and second contact elements;

and sealing the housing to the cover.

* * * * *